US005115535A

United States Patent [19]

Casademunt Ferre et al.

[11] Patent Number: 5,115,535

[45] Date of Patent: May 26, 1992

[54] MOP FOR CLEANING AND POLISHING FLOORS AND OTHER SURFACES

[75] Inventors: Jose M. Casademunt Ferre; Eduardo Fita Valentin, both of Barcelona, Spain

[73] Assignee: Vileda GmbH, Weinheim/Berstrasse, Fed. Rep. of Germany

[21] Appl. No.: 407,894

[22] Filed: Sep. 15, 1989

[30] Foreign Application Priority Data

Sep. 15, 1988 [ES] Spain ..... 8802819

[51] Int. Cl.[5] ..... A47L 13/16

[52] U.S. Cl. ..... 15/229.7

[58] Field of Search ..... 15/145, 223, 229.3, 15/229.4, 229.7, 229.8, 114, 115, 210 R, 228, 220 R, 229.1, 231, 232, 209 R, 226, 227

[56] References Cited

U.S. PATENT DOCUMENTS

| | | | |
|---|---|---|---|
| 722,863 | 3/1903 | Lodge | 15/227 |
| 1,059,364 | 4/1913 | Hollingsworth | 15/223 |
| 1,701,686 | 2/1929 | Maeda | 15/228 |
| 1,706,019 | 3/1929 | Barber | 15/229.7 |
| 2,306,944 | 12/1942 | Gray | 15/209 RX |
| 2,655,680 | 10/1953 | Geerin | 15/227 X |
| 2,779,044 | 1/1957 | Brockmeier et al. | 15/228 |
| 2,784,436 | 3/1957 | Peterson | 15/227 |
| 3,108,304 | 10/1963 | Roy | 15/229.7 X |
| 3,230,565 | 1/1966 | Koch | 15/229.8 |
| 3,528,120 | 9/1970 | Lindstrom | 15/227 X |
| 3,991,432 | 11/1976 | Griffin et al. | 15/229.8 |
| 4,656,686 | 4/1987 | Moss et al. | 15/229.8 X |

FOREIGN PATENT DOCUMENTS

| | | | |
|---|---|---|---|
| 757299 | 4/1967 | Canada | 15/229.8 |
| 1267092 | 6/1961 | France | 15/229.8 |
| 273017 | 6/1983 | Spain . | |
| 289532 | 10/1985 | Spain . | |
| 462398 | 10/1968 | Switzerland | 15/229.8 |

*Primary Examiner*—Harvey C. Hornsby
*Assistant Examiner*—Scott J. Haugland
*Attorney, Agent, or Firm*—Kenyon & Kenyon

[57] ABSTRACT

A mop for simultaneous scrubbing and polishing floors and other surfaces comprised of an upper and lower bonded-fiber sections. The upper section comprises, a plurality of joined bonded-fiber fabric layers which diminish in size from top to bottom, and each layer having fringes cut in the outer edges thereof. The bottom section is free of fringes and comprises a plurality equal-sized bonded-fiber fabric layers, which, are smaller, however, than the layers of the upper section. The uppermost bonded-fiber fabric layer in the upper section has a central opening and a pair of opposing pockets, into which a stiff mounting support is inserted, and the mounting support being of substantially the same size and shape as the lower section and aligned therewith when positioned in the pockets.

11 Claims, 2 Drawing Sheets

MOP FOR CLEANING AND POLISHING FLOORS AND OTHER SURFACES

FIELD OF THE INVENTION

The present invention relates to a mop for simultaneously cleaning and polishing floors and other surfaces.

BACKGROUND OF THE INVENTION

A mop-like polishing device is disclosed in Spanish Design Patent No. 175,229. This device consists of a flat cover with a built-in stiff, mounting support, i.e., a metal-frame. The mounting support engages with the flat cover through an opening provided with a zipper fastener. The mounting support consists of an elongated ring having a centrally disposed means for attaching a handle, projecting out of an opening in the cover. Rows of string, which are secured with a seam, hang out of the cover. Attaching the handle to this device is a cumbersome process because it is difficult to insert the mounting support through the opening in the cover.

A mop-like cleaning device is disclosed in Spanish Design Patent No. 278,339. This device consists of a flexible, elongated piece of fabric, which has some fringes on its edges. The bottom side of the fabric forms a wiper portion which contacts a surface to be cleaned. Opposite-facing pockets are attached to the top side of the fabric so that a flexible, hinged mounting support with a handle can be inserted. A disadvantage of this device is that the same bottom surface of the wiper portion must be used for both wiping and polishing operations. Consequently, if pressure is applied for polishing operations, dirt picked up by the bottom surface during cleaning may be pressed back into the floor.

OBJECTS AND SUMMARY OF THE INVENTION

An object of the present invention is to provide a mop having a wiper part which enables both cleaning and polishing simultaneously, whereby different amounts of pressure can be simultaneously applied to a surface being wiped with the mop.

This invention provides a mop for simultaneous cleaning and polishing, comprising a lower section joined to an upper section said lower section comprising a plurality of joined fabric layers of substantially the same size and shape said upper section comprising a plurality of joined fabric layers of substantially the same shape arranged in a stack and sized so that said stack tapers outwardly from a bottom layer to a top layer the top layer being joined to an adjacent layer in said upper section so that a pocket is formed therebetween for engaging and aligning a stiff mounting support of substantially the same size and shape as said lower section and an opening in said top layer for inserting the mounting support into said pocket.

A preferred mop of this invention comprises a flat, bonded-fiber fabric structure including an upper fabric section, having a matted surface which provides a peripheral graduation (tapering) so that the size of the surface diminishes from top to bottom. The top edges of the surface is cut to form fringe-type strips. The lower section consists of equal-sized bonded-fiber fabric segments, however they are smaller than the upper bonded-fiber fabric segments. The individual fabric segments are connected by seams. The upper fabric surface has a central opening and two opposite-facing pockets into which one inserts a mounting support for attaching conform precisely to the lower fabric section.

In a more preferred embodiment, seams run along the center longitudinal axis of rectangular bonded-fiber fabric segments hold the individual segments together, with the exception of the upper fabric segments, and other seams run around the central opening of the upper fabric segment and its pockets in an oval, closed line connecting the upper fabric segment only with the one lying directly below it.

In another preferred embodiment several side-by-side seams, which run around the central opening of the upper fabric segment, as described above, and connect all bonded-fiber fabric layers to each other.

Likewise, in a refinement of the invention, the pockets are attached with a separate seam to the fabric segment situated directly beneath them.

The opposite-facing pockets of the upper fabric segment can also be formed by folding both fabric portions forming the opening (tongues) to the inside. The fabric portions forming the opening are created when the central opening of the upper bonded-fiber fabric section is cut out, as hereinafter described.

BRIEF DESCRIPTION OF THE DRAWINGS

The invention is illustrated, by way of example, in the drawings appended hereto in which.

DETAILED DESCRIPTION OF THE INVENTION

Figure 1:
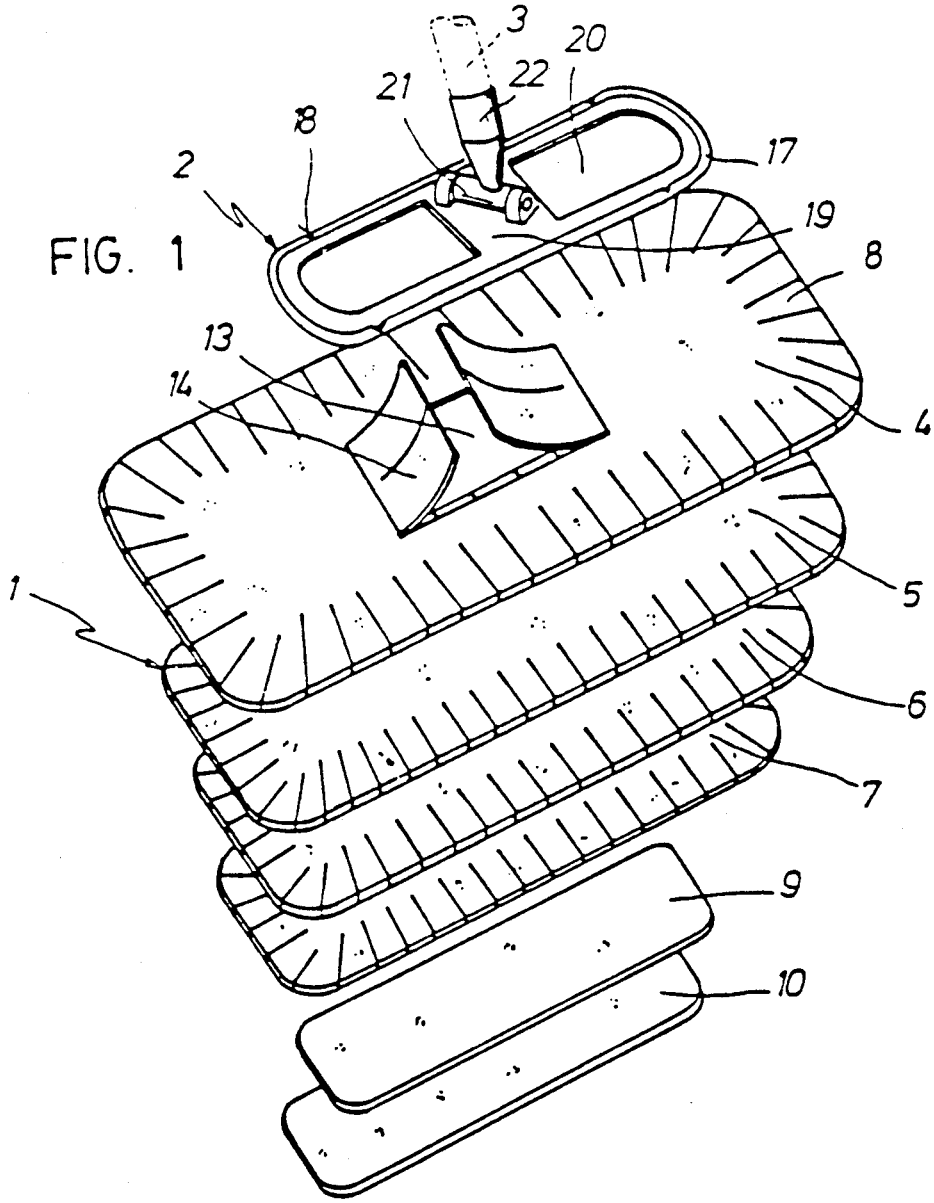
FIG. 1 illustrates a mop and associated mounting support constructed in accordance with the invention.
Figure 3:
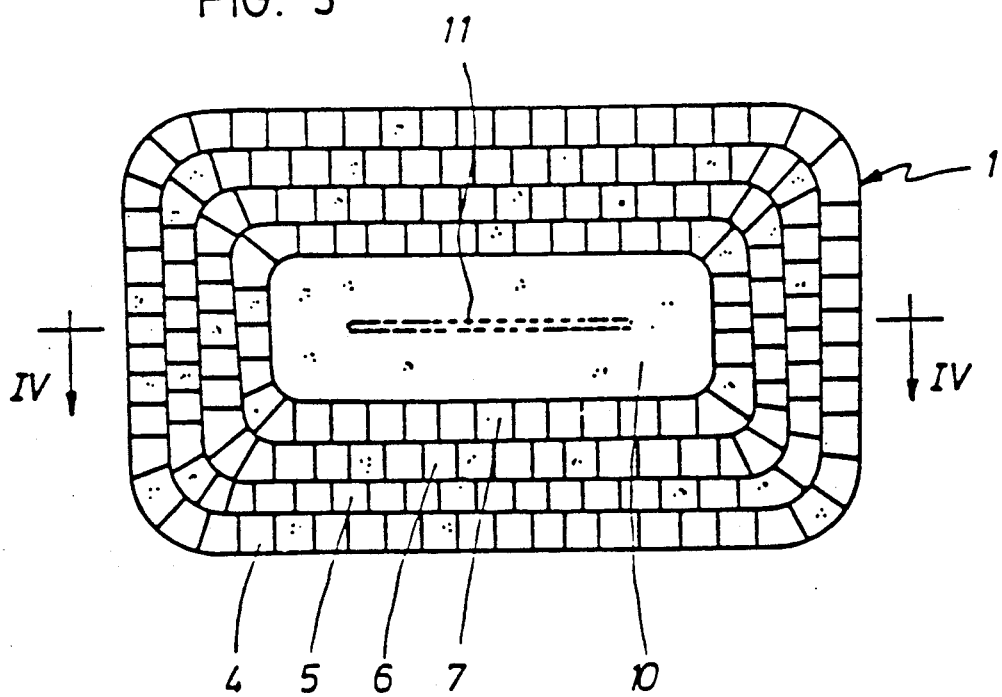
FIG. 3 is a bottom plan view of the mop of FIG. 1.

Referring first to FIG. 1, mop 1 is connected (as shown in FIG. 3) to a mounting support 2, so that it can be attached to a handle 3 needed for manual handling. According to the invention, this mop 1 comprises a flat structure made of absorbent bonded-fiber fabric layers joined by seams. The preferred shapes for the flat structure is rectangular with rounded corners, or an oval shape.

The flat structure comprises an upper section and a lower section. In the present example, the upper section includes four fabric layers 4, 5, 6 and 7 having diminishing surface areas respectively from top to bottom, i.e., uppermost or adjacent layer 4 is larger than layer 3 and so on, so that the edge of the upper section is tapered outwardly from the bottom layer of the upper section layer 7. The peripheral edges of each of layers 4, 5, 6 and 7 are cut to provide strips 8, which collectively form fringes. In the illustrated embodiment, the bottom section comprises two similarly shaped fabric layers 9 and 10, which are about the same size and preferably smaller than the bottom layer 7 of the upper section, and preferably have uncut edges.

Figure 4:
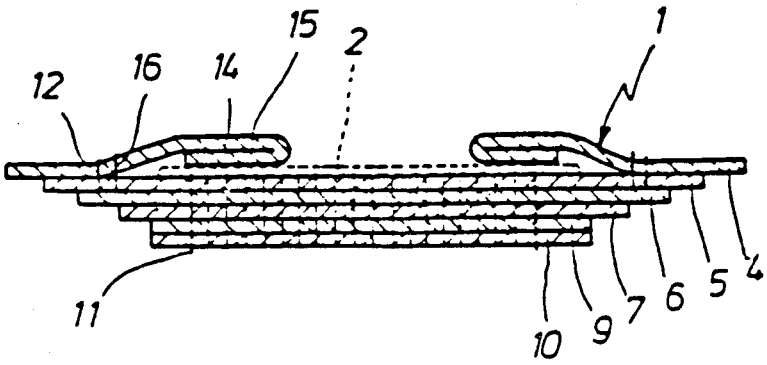
FIG. 4 is a cross-sectional view of the mop of FIG. 1 taken along line IV—IV in FIG. 3.
Figure 2:
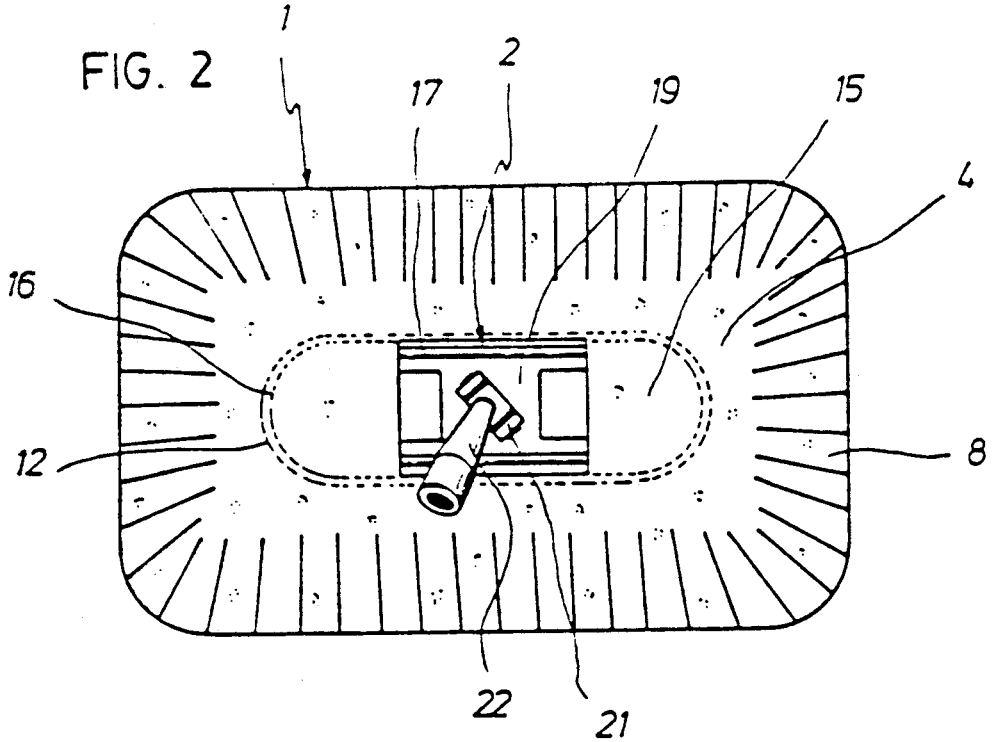
FIG. 2 is a top plan view of the mop of FIG. 1.

The fabric layers of the upper and lower sections are joined to form the flat structure with central seams 11, which hold together all fabric layers, with the exception of the uppermost fabric layer 4. Seams 12, are positioned to define an inner section in a closed line, joining the uppermost fabric layer 4 with the adjacent fabric layer 5, as shown in FIGS. 2 and 4.

The uppermost fabric layer 4 includes a central rectangular opening 13, out of which two tongue-shaped flaps 14 protrude (FIG. 1). Both sections are folded to the inside forming reinforced pockets 15, which are attached with separate seams 16 (FIGS. 2 and 4).

The pockets 15 capture the ends of the mounting support 2. The mounting support 2 comprises a flat, semi-rigid body of, e.g., synthetic resin having an edge ribbing 17 and grooves 18 for providing flexibility and further includes a central section 19 between two opposite openings 20. A hinge joint is provided in the central section 19 to connect a coupling arm 22 for attaching handle 3.

A feature of the mop 1 of the invention is that the fabric layers 9 and 10 of the lower section are substantially the same size and shape as the mounting support 2. When mounting support 2 is positioned within pocket 15 the edge 17 is substantially aligned with the periphery of the lower section. Thus, the working surface of the mop has a central zone for scrubbing which efficiently transmits force via the handle 3 to the lower fabric segments 9 and 10, and an outer zone comprising the fringes of the fabric layers 4, 5, 6, 7 for gentle wiping. therefore, it is possible with the mop of the invention to simultaneously apply two different pressures to a surface to be treated during ordinary wiping strokes with the mop, thus providing a simultaneous cleaning and polishing process.

While the present invention has been particularly described in terms of specific embodiments thereof, it will be understood in view of the present disclosure that numerous variations within the scope of the invention are now enabled to those skilled in the art. Accordingly, the invention is to be broadly construed and limited only by the spirit and scope of the claims below.

What is claimed is:

1. A mop for mounting on a stiff mounting support and simultaneous cleaning and polishing, comprising:

a lower section;

an upper section joined to said lower-section;

said lower section comprising a plurality of joined fabric layers of substantially the same size and shape;

said upper section comprising a plurality of joined fabric layers including a bottom layer and top layer, said fabric layers having substantially the same shape, arranged in a stack and sized so that said stack tapers outwardly from said bottom layer to said top layer, and the fabric layers of the upper section being larger than those of the lower section;

the fabric layers of the upper section further including an adjacent layer joined to said layer so that a pocket is formed therebetween for engaging and aligning a stiff mounting support of substantially the same size and shape as said lower section; and an opening in said adjacent layer for inserting said mounting support into said pocket.

2. The mop of claim 1, wherein said upper section includes four fabric layers each having fringed edges; and said lower section includes two layers; and further includes seams for joining the layers together.

3. The mop of claim 2, wherein the mop shape is rectangular having rounded corners.

4. The mop of claim 2, wherein said seams include a seam that runs along a central longitudinal axis of the stack and joins all layers except the adjacent layer.

5. The mop of claim 4, wherein said seams include a plurality of seams lying side-by-side running around said opening and said pocket in an oval pattern connecting the top and adjacent fabric layers to each other.

6. The mop of claim 4, wherein said pocket is formed between said top and adjacent and the seam connecting them is a separate seam.

7. The mop of claim 4 wherein a central portion of said adjacent layer is cut and folded into said pocket to form said opening.

8. The mop of claim 2, wherein said pocket is formed between said top and adjacent layers by a separate seam.

9. The mop of claim 2, wherein a central portion of said adjacent layer is cut and folded into said pocket to form said opening.

10. The mop of claim 1, wherein said pocket is formed between said top and adjacent layers by a separate seam.

11. The mop of claim 1, wherein a central portion of said adjacent layer is cut and folded into said pocket to form said opening.

* * * * *

UNITED STATES PATENT AND TRADEMARK OFFICE

CERTIFICATE OF CORRECTION

PATENT No. : 5,115,535

DATED : May 26, 1992

INVENTOR(S): Jose M. C. Ferre et al.

It is certified that error appears in the above-identified patent and that said Letters Patent is hereby corrected as shown below:

Column 2, line 1, after "attaching" insert -- a handle. The position and size of these pockets must --.

Signed and Sealed this

Sixteenth Day of July, 1996

*Attest:*

*Attesting Officer*

Bruce Lehman

BRUCE LEHMAN

*Commissioner of Patents and Trademarks*